250-203 R AU 252 EX
11/6/79 XR 4,173,777

United States Patent [19]

Schmit et al.

[11] 4,173,777

[45] Nov. 6, 1979

[54] JET AIRCRAFT AND/OR MISSILE PLUME SIMULATOR

[75] Inventors: David E. Schmit; Jon C. Richmond, both of Cincinnati, Ohio

[73] Assignee: Cincinnati Electronics Corporation, Cincinnati, Ohio

[21] Appl. No.: 802,549

[22] Filed: Jun. 1, 1977

[51] Int. Cl.[2] ..... F21V 33/00

[52] U.S. Cl. ..... 362/253; 362/294; 250/203 R

[58] Field of Search ..... 250/203 R, 209, 493, 250/495; 35/12 R, 12 B; 362/294, 253

[56] References Cited

U.S. PATENT DOCUMENTS

| | | | |
|---|---|---|---|
| 2,983,823 | 5/1961 | Oberly | 250/495 X |
| 3,383,902 | 5/1968 | Gragin et al. | 250/495 X |
| 3,857,042 | 12/1974 | LaGrange et al. | 250/495 X |
| 3,930,150 | 12/1975 | Marantette | 250/203 R |
| 3,942,447 | 3/1976 | Van Orsdel et al. | 250/338 X |
| 3,996,494 | 12/1976 | Suga | 250/205 X |
| 4,021,622 | 5/1977 | Mimms | 250/203 R |

*Primary Examiner*—Peter A. Nelson

*Attorney, Agent, or Firm*—Lowe, King, Price and Becker

[57] ABSTRACT

The intensity and spectral content of a jet aircraft and/or missile plume is simulated with a xenon lamp that derives an optical beam which propagates through a filter. The filter prevents optical energy in the visible light region from propagating through it, to prevent eye damage, and enables an output beam to be derived that simulates the intensity and spectral content of the plume. The lamp is normally maintained in a keep-alive status, and its beam power is increased to simulate sudden changes of plume intensity. The beam is selectively passed and blocked by a shutter downstream of the filter to simulate plume presence and absence. The distance between the simulated plume and a target is simulated by controlling the opening of an iris in the beam path. The lamp, filter and drive mechanism for the shutter are cooled by air drawn into a housing by a fan and by fins inside of the housing. The fins are in dull black, radiation absorbing, optical energy trapping structures. The device can be used for testing IR detectors that monitor the plumes.

15 Claims, 5 Drawing Figures

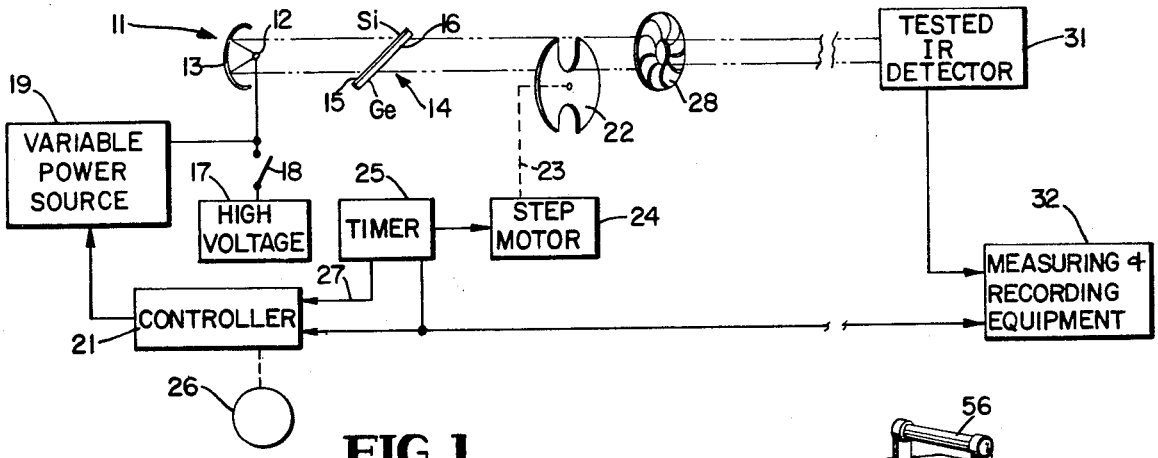
FIG. 1
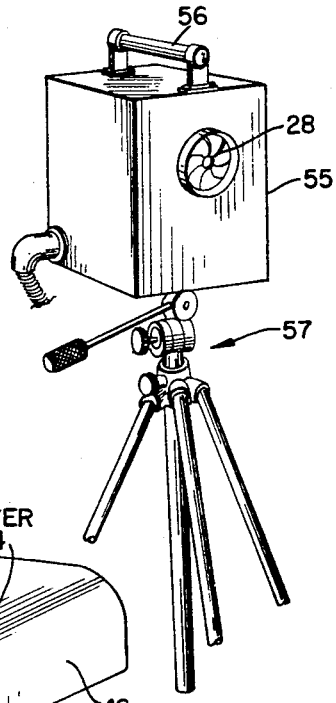
FIG. 3
FIG. 2
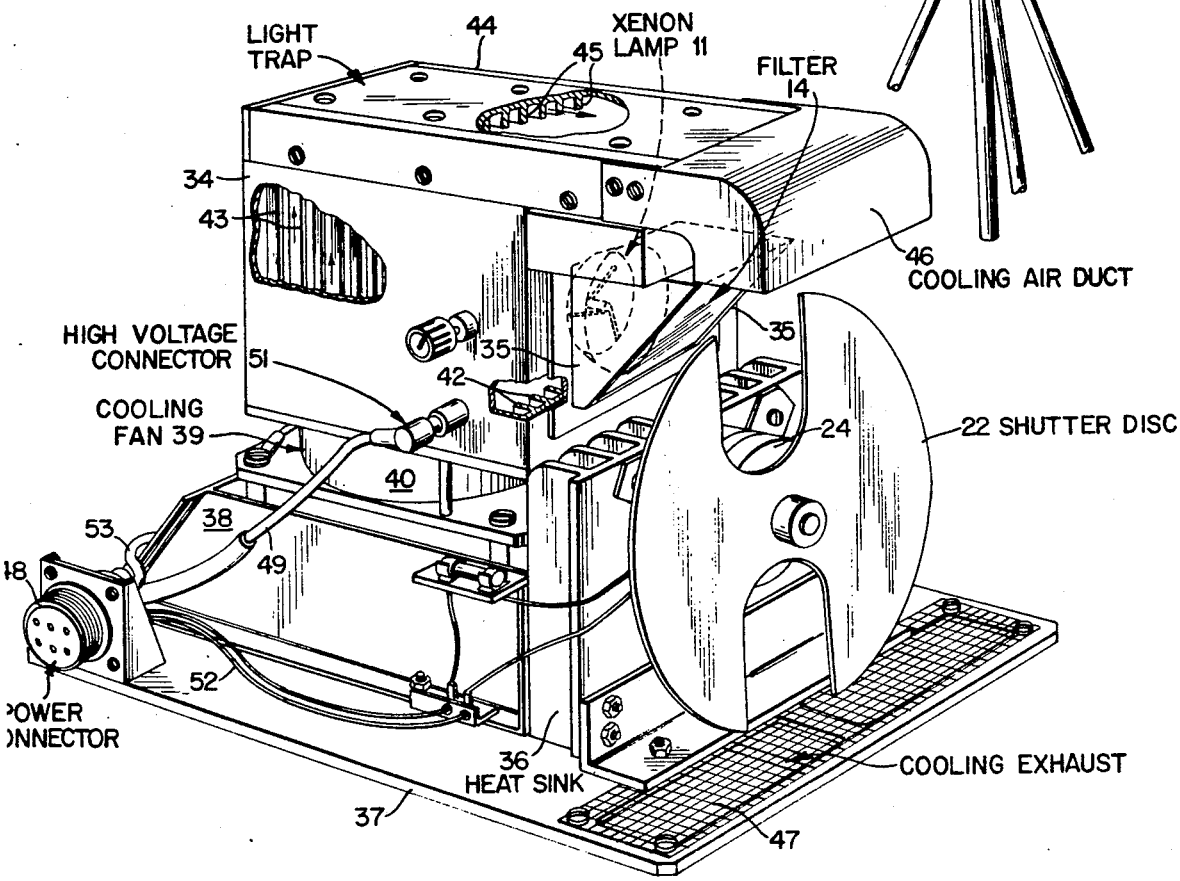

SPECTRAL RADIANCE OF X6241 V/A XENON LAMP - 29 AMPS

EYE SAFE Si-Ge FILTER

JET AIRCRAFT AND/OR MISSILE PLUME SIMULATOR

FIELD OF THE INVENTION

The present invention relates generally to an apparatus for and method of simulating missile and/or jet aircraft plumes, and more particularly, to such an apparatus and method wherein the plume is simulated with an optical source having intensity and spectral characteristics similar to those of the plume.

BACKGROUND OF THE INVENTION

For certain testing purposes, it is necessary to produce optical radiation having intensity and spectral characteristics similar to those of a missile or jet aircraft engine. One such test involves determining the performance of infrared (IR) detectors which warn aircraft of attack by enemy aircraft and/or missiles. The only prior art technique to our knowledge involves firing the engine or missile. Although this technique produces the most realistic radiation characteristics, it is very costly and cumbersome. In addition, the prior art method of simulating missile plumes imposes unrealistic test configurations because of missile/launch safety requirements. It is not feasible to impose such safety requirements on personnel who are, for example, testing infrared detectors.

The requirement to actually fire a missile or start an engine necessitates the use of special test sites that do not permit realistic test configurations in many situations. In particular, the test site is usually located close to the ground and the position of the missile or aircraft engine must be fixed for each individual test. If it is desired to change the orientation of the missile or engine relative to the horizon, or to change the altitude of the missile or aircraft engine, considerable time and effort must be expended. In certain instances, it may even be necessary to actually fly the aircraft or launch the missile, merely for IR detector testing purposes.

A further defect with the prior art technique is that it does not usually enable tests to be performed in environments wherein there is a background, jet aircraft plume on which is superimposed a missile plume. Such a situation frequently exists in real practice and it is desirable to determine the response of a missile and jet aircraft plume detector to such a situation. A further disadvantage of the prior art technique, with regard to missiles, is that a fired missile cannot usually be reused, whereby the test costs are very high. For all of these reasons, the prior art technique has proven to be far less than optimum.

It is, accordingly, an object of the present invention to provide an apparatus for and method of simulating the intensity and spectral characteristics of a missile and/or jet aircraft plume.

A further object of the invention is to provide a new and improved apparatus for and method of testing IR detectors responsive to jet aircraft and/or missile plumes.

An additional object of the invention is to provide an apparatus for and method of simulating the plume of a jet aircraft and/or missile wherein the need to actually fire the aircraft engine or missile is obviated.

A further object of the invention is to provide an apparatus for and method of simulating a jet aircraft, background plume on which is superimposed a missile plume.

A further object of the invention is to provide an apparatus for simulating a plume of jet aircraft and/or missile as it is changing range relative to a target location.

Yet another object of the invention is to provide a relatively inexpensive apparatus for simulating the plume of a jet aircraft and/or missile wherein the orientation of the plume can be easily varied.

Yet another object of the invention is to provide an apparatus for and method of simulating the plume of a jet aircraft and/or missile without imposing safety constraints involved in operating aircraft and launching missiles.

An additional object of the invention is to provide an apparatus for and method of simulating the plume of a jet aircraft and/or missile wherein the device can be located and the method can be performed in a convenient location that allows realistic testing of a detector for the plumes.

A further object of the invention is to provide a reusable apparatus for simulating the plume of a jet aircraft and/or missile.

BRIEF DESCRIPTION OF THE INVENTION

In accordance with the present invention, the plume of a jet aircraft and/or missile is simulated with a source of optical energy that derives a beam having an intensity and spectral content similar to those of the simulated plume. The source includes an electrically powered lamp, preferably a xenon lamp that is normally maintained in a keep-alive status to derive the beam. The quantity of energy in the beam is modulated by selectively blocking and unblocking the beam with a shutter and by increasing the electric power supplied to the lamp while the beam is being derived. By selectively blocking and unblocking the beam, while the lamp is maintained in a keep-alive state, the beam has an energy content similar to that of a relatively distant jet aircraft engine. By increasing the electric power supplied to the lamp while the beam is being derived, the intensity of the beam is increased. Sudden increases in the electric power simulate the sudden presence of a missile firing superimposed on the jet aircraft plume background.

To simulate changes in relative range between a target position and the simulated plume, the total energy in the beam is varied by opening and closing an iris in the beam path. By continuously adjusting the iris aperture, the plume source appears to approach and recede from the target position. Directional changes are simulated by mounting a housing for the source, shutter and iris on a tripod which enables the beam orientation to be changed at will.

Preferably, the source, in addition to including the electrically powered lamp, includes a filter that serves the dual function of protecting the eyes of a viewer and shaping the spectral response of the beam so that it has approximately the same spectral content as a simulated plume over the wavelength band of the simulated plume.

A further feature of the invention is that cooling fins, which function as a heat sink for the heat given off by the lamp, also function as radiant energy absorbing light traps. The cooling fins are formed of a dull black material and are relatively closely spaced so that radiant energy from the lamp and in the beam is trapped thereby and is not re-radiated.

The above and still further objects, features and advantages of the present invention will become apparent upon consideration of the following detailed description of one specific embodiment thereof, especially when taken in conjunction with the accompanying drawing.

BRIEF DESCRIPTION OF THE DRAWINGS

FIG. 1 is a schematic diagram of the optical and electronic apparatus of a plume simulator in accordance with a preferred embodiment of the invention;

FIG. 2 is a perspective view of a portion of the plume simulator;

FIG. 3 is a perspective view of a housing and mounting of the simulator;

DETAILED DESCRIPTION OF THE INVENTION

Figure 4:
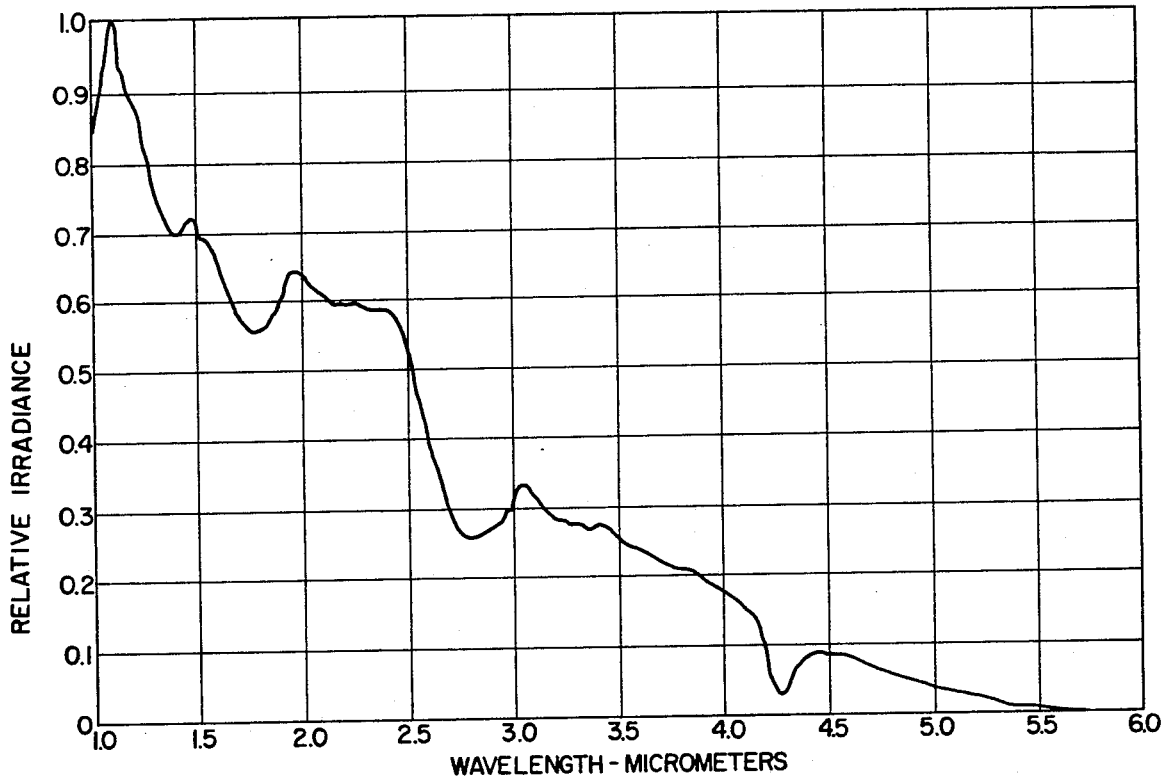
FIG. 4 is a response curve of a preferred form of a xenon lamp utilized in the apparatus of FIGS. 1 and 2.

Reference is now made to FIG. 1 of the drawing wherein a xenon arc lamp 11 emits a beam of optical energy with an intensity sufficiently high to simulate the plume of a jet aircraft engine and/or missile. In one configuration, xenon lamp 11 is a 500 watt X6241 lamp, having a color temperature of 5100° K., available from Varian Associates. Lamp 11 includes an ignition electrode 12 that is positioned at the focus of silvered, parabolic reflector 13; the combination of the ignition electrode and parabolic reflector enables a collimated beam having an angle of 8° to be derived.

The collimated beam is propagated through a sapphire output window, having excellent broad band transmission, thence transmitted through optical filter 14, which together with lamp 11, forms an optical energy source having spectral characteristics similar to those of a simulated plume. Filter 14 includes laminated layers 15 and 16 of silicon and germanium, respectively, which are preferably positioned so that the silicon laminate faces lamp 11 and the germanium laminate is on the reverse side. This particular arrangement has been found most desirable because the radiation reflecting and absorbing properties of silicon and germanium enable the filter to absorb a minimum amount of radiation from lamp 11, to prevent overheating of the filter and breaking thereof. To facilitate cooling of filter 14, it is inclined at 45° relative to the axis of the beam derived from lamp 11. Silicon-germanium filter 14 is particularly advantageous because it functions as an eye safety filter so that eyes of testing personnel or an observer are not harmed by the intense radiation in beam 11. In addition, filter 14 shapes the spectral characteristics of the beam derived from lamp 11 to simulate the desired characteristics.

Figure 5:
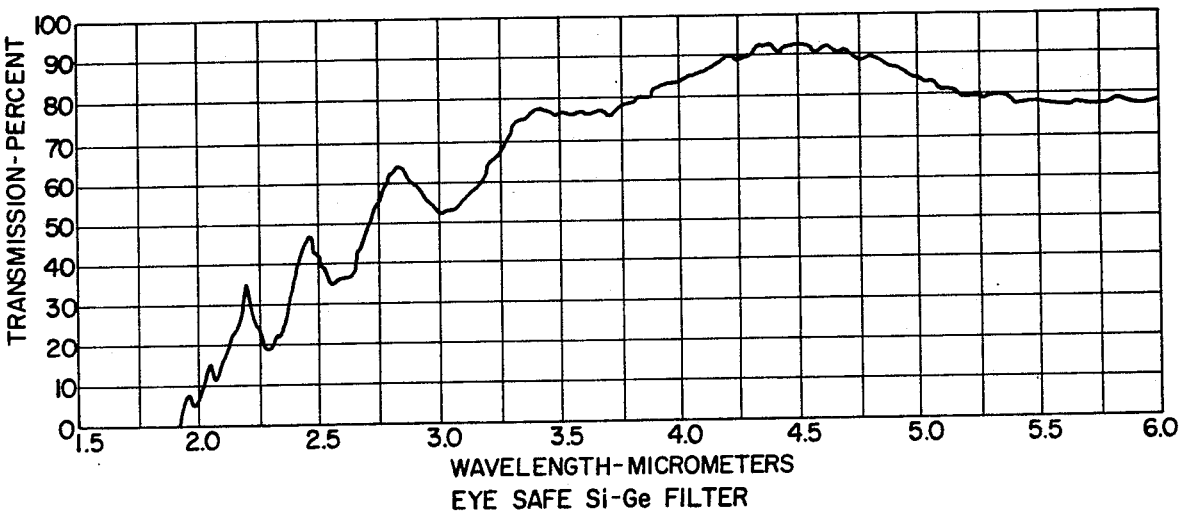
FIG. 5 is a response curve of a filter utilized in the apparatus of FIGS. 1 and 2.

The irradiance versus wavelength response of lamp 11 is illustrated in FIG. 4, while the transmission amplitude versus wavelength response of filter 14 is illustrated in FIG. 5. From an analysis of FIGS. 4 and 5, it is apparent that wavelengths shorter than 1.8 micrometers are not passed through filter 14 and there is no substantial radiation which can harm the eyes. Because there is substantially no radiation emitted from lamp 11 for wavelengths longer than 5.5 micrometers, the beam propagating through filter 14 has no energy at a wavelength longer than 5.5 micrometers. Hence, the energy propagating through filter 14 is limited to the wavelengths between approximately 1.8 and 5.5 micrometers, the wavelength of interest to simulate the spectral characteristics of the simulated plumes. If it is desired to simulate plumes having different wavelength versus amplitude response, different combinations of lamps and filters may be employed.

When the source comprising lamp 11 and filter 14 is in a quiescent, ready to be used state, the lamp is maintained in a keep-alive status. In a keep-alive status, the beam derived from lamp 11 has the lowest possible intensity. The beam is initially derived by applying a high voltage to electrode 12 by high voltage source 17 that is connected to the electrode through normally open switch 18. The keep-alive status is established by applying a current from a relatively low amplitude voltage source 19 to electrode 12 while high voltage source 18 is connected to electrode 12; the amplitude of the current supplied by source 19 to electrode 12 is controlled by current controller 21. With the beam of lamp 11 established in a keep-alive status, switch 18 is open-circuited and an optical energy beam simulating the plume of a missile and/or jet aircraft engine propagates through filter 14.

With the beam of lamp 11 established, shutter 22 is opened for a length of time equal to the time that the simulated plume crosses a field of view. To this end, shutter 22 is driven in a stepwise manner by shaft 23 of step motor 24; alternatively, step motor 24 can be a solenoid. Motor 24 is controlled by pulses from timer 25 so that the shutter remains in a stationary condition throughout the interval while the simulated plume is in the field of view. As the simulated plume moves into and out of the field of view, shutter 22 is rapidly moved from a closed to an open state, and vice versa, respectively. Thereby, substantial step changes in the intensity of the optical energy beam propagated through shutter 22 occur from a zero level to some finite intensity.

The beam propagating through shutter 22 can simulate an intense plume or a relatively low intensity plume. A relatively low intensity beam simulates the plume of an aircraft jet engine at a relatively great distance from a target location, or the plume of a missile from a greater distance. Such a plume is simulated by maintaining the voltage of source 19 at a minimum level to establish the beam keep-alive status. To simulate the plume of a missile at very short range, source 19 is activated so that the voltage applied to electrode 12 results in a maximum intensity of the beam from lamp 11 for the entire time while shutter 22 is in an open condition. The level of the voltage of source 19 is controlled by controller 21, having a manual input knob 26. For conditions between the maximum and keep-alive intensities of the beam of lamp 11, knob 26 is set to differing positions. The minimum setting of knob 26 maintains the beam at a minimum keep-alive intensity while the maximum setting of the knob results in a maximum intensity beam.

Timer 25 activates controller 21 and step motor 24 in synchronism so that the leading and trailing edges of current increases and decreases supplied by source 19 to electrode 12, as superimposed on the keep-alive level, occur immediately before the shutter opening and immediately after the shutter closing. To this end, the duration of the beam intensity above the keep-alive level, and at a level determined by knob 26, is established by timer 25 driving controller 21 and motor 24 in parallel.

It is also possible to simulate the condition of a missile ignition plume superimposed on a jet aircraft engine plume. The missile ignition has a relatively short duration, with steep leading and trailing edges relative to the total length of time of the aircraft engine plume. To these ends, timer 25 is pre-programmed to derive a relatively short duration output pulse that is supplied via lead 27 exclusively to controller 21. The pulse on lead 27 occurs intermediate between the opening and closing of shutter 22. The pulse on lead 27 causes controller 21 to activate source 19 so that a short duration, maximum intensity beam is derived from lamp 11 for the relatively short time of the pulse derived from timer 25. Typically, shutter 22 is maintained in an open condition for approximately 2 seconds to simulate an aircraft plume, while the maximum intensity light pulse is derived from lamp 11 for approximately a couple of hundred milliseconds to simulate the missile ignition superimposed on the jet aircraft engine plume. Because of the relatively short duration of the high intensity beam, it is necessary to utilize electronic, rather than mechanical or electromechanical, control for the high optical energy impulse.

To simulate changes in the relative range between the simulated source and a target, either on a static or dynamic basis, a variable aperture iris 28 is provided downstream of shutter 22 in the path of the beam derived from lamp 11 and propagating through the shutter. Iris 28 can be preset and maintained with a constant aperture to simulate a fixed distance between a simulated plume and a target. Alternatively, iris 28 can be gradually opened and closed by manual or motorized control, while the beam is being derived from lamp 11 to simulate decreases and increases in the range between the simulated plume and the target position. With either type of simulation, iris 28 selectively changes the total energy in the beam propagating from the source to simulate differing ranges between the simulated plume and a target.

One of the principle uses of the simulated plume source is to test infrared detectors. To this end, an infrared detector 31 is positioned to be responsive to the beam derived from the lamp 11 and propagating through iris 28. Detector 31 may be spaced a considerable distance from the plume simulator. Tests have been conducted with detector 31 located approximately one mile from the plume simulator. Detector 31 supplies an output signal to suitable measuring and recording equipment 32; the recording equipment may include a multichannel chart recorder, having one channel responsive to the amplitude of the IR level derived from detector 31. Another channel of the recorder included in equipment 32 may be a time base responsive to the output of timer 25, and which inducates the time when step motor 24 drives shutter 22 to the open and closed states, as well as indications of the time when pulses are derived from the timer to simulate missile ignition. Further channels of the recorder can be responsive to position transducers for knob 26 and the opening or iris 28, e.g., potentiometers, to indicate the intensity of the simulated plumes. The responses of the several channels are correlated by personnel testing detector 31 to determine if the detector performance is satisfactory.

Reference is now made to FIG. 2 of the drawing wherein there is illustrated a perspective view of the interior of the housing in which are located lamp 11, filter 14, shutter 22 and step motor 24. Lamp 11 is mounted in the interior of a hollow cube 34 having an open top face and a circular aperture in its bottom face. On the front face of cube 34 is an aperture through which the beam from lamp 11 is derived. Surrounding the aperture on the front face of cube 34 are mounting plates 35 for securing filter 14 in situ at a 45° angle relative to the horizontal, and 45° to the boresight axis of the beam derived from lamp 11 in the horizontal direction.

Positioned slightly forward of the front face of cube 34 is a finned, metal mounting block 36 on which step motor 24 is fixedly mounted. Step motor 24 has an output shaft that horizontally extends forward of mounting block 36 and to which shutter disc 22 is fixedly connected.

Because of the heat generated by the continuous operation of lamp 11, it is necessary to cool the lamp, filter 14 and step motor 24. To these ends, a cool flow of air is drawn into cube 34, thence is blown over filter 14 and step motor 24. In addition, finned metal heat sinks are provided to remove heat from these components. Some of the heat sinks have a dull black, radiation absorbing color with closely spaced fins to function as optical radiant energy traps for optical radiation derived from the beam of lamp 11, to provide a beam with greater collimation.

To these ends, cool air is drawn through a grid (not shown) supported in an aperture of base plate 37 into plenum 38 by fan 39 that is located in shroud 40. Fan 39 is mounted so that its axis is vertically directed and its blades lie in a substantially horizontal plane. A relatively good seal exists between the interior of cube 34 and the grid in base plate 37, at the air entrance region into plenum 38. On the front and back interior walls of cube 34 are fixedly mounted finned heat sinks 42 and 43, respectively; two pairs of heat sinks 42 are provided, one above and one below lamp 11. Heat sinks 42 and 43 are arranged so that the longitudinal axes of the fins extend vertically so that air drawn into the cube can easily flow over the fins in a vertical direction.

The air flowing vertically out of the top face of cube 34 is horizontally directed toward the front of the assembly, where filter 14 and step motor 24 are located, by metal chute 44 that forms a heat sink. Chute 44 is sealingly attached to the side and back walls of cube 34 so that virtually all of the air that flows out of the top of the cube flows into the chute. Chute 44 includes downwardly depending heat fins 45 having parallel, longitudinal axes that extend from the rear wall of cube 34 toward the front of the assembly, where filter 14 and motor 24 are located. Fins 45 are spaced relatively close to each other so that they function as radiant energy traps for the radiant optical energy derived from lamp 11. Hence, fins 45 effectively absorb the radiation collected thereby and do not permit it to be re-radiated as heat or as decollimating optical energy. Air flowing between fins 45 toward the front of the assembly, is directed downwardly against filter 14 and motor 24 by a right angle duct 46 at the forward end of chute 44. Chute 44 extends slightly beyond the forward end of disc 22 and completely beyond the forward end of step motor 24. The air directed downwardly against filter 14 and step motor 24 by duct 46 cools the filter and step motor. In addition, step motor 24 is cooled by mounting it on finned mounting plate 36. The longitudinal axes of the fins in mounting plate 36 extend vertically so that air from duct 46 flows easily between them.

The fins of heat sink 42 also assist in cooling filter 14 because of the relatively high thermal conductivity path established by metal mounting plates 35 and the metal front face of cube 34. A fairly high thermal conductivity path is provided between the relatively massive metal base 37 and mounting plate 36 to augment the flow of heat away from step motor 24. Air flowing over step motor 24 is exhausted from the assembly through grid 47, in base plate 37 forward of mounting plate 36.

Electric power is supplied to the various components requiring it by a power connector 48, mounted on base plate 37. Cable 49 provides energization for lamp 11, by a connection to high voltage terminal 51, mounted on one side of cube 34. Additional lead wires 52 and 53 respectively extend between power connector 48 and step motor 24 and fan 39.

The entire apparatus illustrated in FIG. 2 is contained in light-tight housing 55, having the form of a right parallepiped that is carried by base plate 37. Housing 55 includes variable aperture iris 28 in its front wall, in alignment with lamp 11, filter 14, and the aperture of shutter 22 when the housing is secured to the assembly of FIG. 1. Mounted on the top face of housing 55, and in alignment with the boresight axis of the beam derived from lamp 11 and filter 14 is a sighting tube 56. To enable the beam propagating through iris 28 to be directed at any azimuth or elevation, base plate 37 is fixedly mounted to tripod 57 having a mount with two degrees of rotation. To direct the simulated beam propagating through iris 28 onto a desired target, such as detector 31, the position of housing 55, on tripod 57, is adjusted until the target is sighted through tube 56.

While there has been described and illustrated one specific embodiment of the invention, it will be clear that variations in the details of the embodiment specifically illustrated and described may be made without departing from the true spirit and scope of the invention as defined in the appended claims. If it is desired to simulate different types of radiation sources, multiple lamps and/or filters can be selectively utilized in a mechanism different from that illustrated in FIGS. 1 and 2. If necessary or desirable, a built-in radiation detector and monitoring electronics can be provided to assure constant output intensity from the lamp. Such a monitor also provides an instrumentation signal to indicate the characteristics of the output radiation in time and intensity.

What is claimed is:

1. Apparatus for simulating jet aircraft and/or missile plumes comprising a source of optical energy for deriving a beam having an intensity and spectral content similar to those of the simulated plume over a wavelength band of the simulated plume, said source including an electrically powered lamp, means for modulating the energy of the beam, said means for modulating including variable aperture means in the beam path, and means for controlling the power applied to the lamp so that beams of at least two intensities are derived from the lamp.

2. The apparatus of claim 1 wherein the source further includes an optical filter in the beam path, the combined output response of the lamp and absorption response of the filter providing the beam having said intensity and spectral response.

3. The apparatus of claim 2 wherein the filter prevents the propagation through it of substantially visible, optical energy from the lamp.

4. The apparatus of claim 3 wherein the filter includes surfaces of silicon and germanium, and the lamp is a xenon lamp, the silicon surface facing the xenon lamp.

5. The apparatus of claim 1 wherein the variable aperture means includes a shutter in the beam path and a variable iris in the beam path, means for opening the shutter and maintaining it in an open condition for a predetermined interval, and means for changing the iris opening while the shutter is open.

6. The apparatus of claim 5 further including means for changing the power supplied to the lamp while the shutter is open.

7. The apparatus of claim 1 further including timing means for opening the variable aperture means and controlling the power applied to the lamp so that at least a predetermined power level, necessary to derive a beam from the lamp, is applied to the lamp all the time the aperture means is open and for enabling the power level applied to the lamp to be substantially above the predetermined level while the aperture means is open.

8. The apparatus of claim 1 including timing means for opening the variable aperture means and controlling the power applied to the lamp so that at least a keep-alive power level necessary to derive a beam from the lamp is applied to the lamp all the time the aperture means is open and for enabling the power level applied to the lamp to be increased substantially above the keep-alive level while the aperture means is open.

9. The apparatus of claim 1 further including means for cooling the source.

10. The apparatus of claim 9 wherein the means for cooling includes fan means for drawing air into a housing for the lamp through a flow path entering and exiting the housing remote from the lamp, said flow path being around the lamp and including heat sink and optical energy trapping fins for absorbing radiant energy from the lamp.

11. The apparatus of claim 10 wherein the fins and a mounting for the fins are dull black, radiant absorbing optical energy trapping members.

12. A method of simulating jet aircraft and/or missile plumes comprising activating an electrically powered, optical energy emitting lamp included in a source having an intensity and spectral content similar to those of the plume so that the source derives a beam similar to a beam derived from a simulated plume over a wavelength band of the simulated plume.

13. The method of claim 12 further including the step of modulating the quantity of energy in the beam by changing the electric power supplied to the lamp while the beam is being derived from the lamp to simulate sudden changes in the quantity of the plume energy, and opening and closing a shutter in the beam path to respectively simulate the presence and absence of plume energy.

14. The method of claim 13 further including varying the size of an aperture in the beam path to simulate gradual changes in the quantity of energy in the simulated plume.

15. The method of claim 13 further including varying the size of an aperture in the beam path to simulate range changes between the simulated plume and a target position.

* * * * *